US008001896B2

(12) United States Patent
Büchner

(10) Patent No.: US 8,001,896 B2
(45) Date of Patent: Aug. 23, 2011

(54) INK DOSING DEVICE OF A PRINTING GROUP, AND METHOD FOR CONTROLLING THE INK DOSING DEVICE

(75) Inventor: Detlef Alfons Büchner, Dorfprozelten (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 150 days.

(21) Appl. No.: 12/310,405

(22) PCT Filed: Aug. 9, 2007

(86) PCT No.: PCT/EP2007/058253
§ 371 (c)(1),
(2), (4) Date: Feb. 24, 2009

(87) PCT Pub. No.: WO2008/028744

PCT Pub. Date: Mar. 13, 2008

(65) Prior Publication Data

US 2009/0320702 A1 Dec. 31, 2009

(30) Foreign Application Priority Data

Sep. 6, 2006 (DE) ..... 10 2006 041 881

(51) Int. Cl.
*B41F 31/02* (2006.01)
*B41F 31/00* (2006.01)
*B41F 31/04* (2006.01)
*B41F 33/00* (2006.01)

(52) U.S. Cl. ..... 101/365; 101/DIG. 47; 101/484; 101/485

(58) Field of Classification Search ..... 101/365, 101/DIG. 47, 484, 485
See application file for complete search history.

(56) References Cited

U.S. PATENT DOCUMENTS 6,142,078 A * 11/2000 Lachajewski ..... 101/484

(Continued)

FOREIGN PATENT DOCUMENTS

DE 42 16 440 B4 11/1993

(Continued)

OTHER PUBLICATIONS

Kipphan, Helmut (Ed.), "Handbook of Print Media: Technologies and Production Methods," Springer Verlag, Heidelberg, ISBN 3-540-67326-1, 2001, pp. 213-219; 284-287; 325-327; and 923-036 (in English).

(Continued)

*Primary Examiner* — Daniel J Colilla
*Assistant Examiner* — Leo T Hinze
(74) *Attorney, Agent, or Firm* — Jones, Tullar & Cooper, P.C.

(57) ABSTRACT

An ink dosing device of a printing group, that includes a printing group cylinder which is configured as a plate cylinder, includes an inking unit. The ink dosing device has a number of physical zones which are arranged next to each other in a longitudinal direction. These physical zones can be individually adjusted by the use of dosing elements in order to individually adjust, section by section, the amount of ink that is applied. A control station is provided with a number of operator elements which are assigned to virtual zones of a printed page. These operator elements are usable to trigger the dosing elements. The segmentation of the virtual zones of the ink dosing device, in relation to the width of a printed page, differs in number and/or position of the zones of the ink dosing device across the width of the printed page from the segmentation of the zones in the control station in relation to the width of the printed page with respect to the number and/or position of the zones in the control station across the width of a printed page. At least two dosing elements are allocated using computing technology to at least one of the operator elements with respect to the relevance of the latter for the adjustment process following the selection of the operator element.

10 Claims, 3 Drawing Sheets

U.S. PATENT DOCUMENTS

| | | | | |
|---|---|---|---|---|
| 6,167,806 | B1 | 1/2001 | Chretinat et al. | |
| 6,742,451 | B1 | 6/2004 | Junghans | |
| 2008/0036800 | A1 * | 2/2008 | Kishigi et al. | 347/5 |

FOREIGN PATENT DOCUMENTS

| | | | | |
|---|---|---|---|---|
| DE | 198 56 675 | A1 | | 9/1999 |
| DE | 100 28 317 | A1 | | 12/2000 |
| DE | 101 31 825 | C1 | | 2/2003 |
| DE | 10 2004 022 700 | B3 | | 10/2005 |
| DE | 10 2004 018 743 | A1 | | 11/2005 |
| DE | 10 2004 054 599 | A1 | | 2/2006 |
| GB | 2217653 | A | * | 11/1989 |
| WO | WO 91/15369 | | | 10/1991 |

OTHER PUBLICATIONS

Kipphan, Helmut (Ed.), "Handbuch der Printmedien: Technologien und Produktionsverfahren," Springer Verlag, Heidelberg, ISBN 3-540-66941-8, 2000, pp. 339-341 (in German).

Kipphan, Helmut (Ed.), "Handbuch der Printmedien: Technologien und Produktionsverfahren," Springer Verlag, Heidelberg, ISBN 3-540-66941-8, 2000, pp. 221-228; 296-299; 961-975 (in German).

Teschner, Helmut, "Informationsverarbeitung Offset Druck Technik, Technologien und Werkstoffe in der Druckindustrie," Fachschriften-Verlag GmbH & Co., Fellbach, ISBN 3-921217-14-8, 1997, pp. 10/107-10/127 (in German).

WIFAG Information Brochure, "Evolution," WIFAG Informationsbullein—Ausgabe 40, Bern, Switzerland, Apr. 2006, 32 pp. (in German).

IFRA, Internationales Magazin fur Zeitungsstrategie, Business und Technologie, "Variable Farbzonentastatur von EAE," Apr. 1, 2008, 2 pp. (in German).

* cited by examiner

INK DOSING DEVICE OF A PRINTING GROUP, AND METHOD FOR CONTROLLING THE INK DOSING DEVICE

CROSS-REFERENCE TO RELATED APPLICATIONS

This application is the U.S. national phase, under 35 U.S.C. 371, of PCT/EP 2007/058253, filed Aug. 9, 2007; published as WO 2008/028744 A1 on Mar. 13, 2008 and claiming priority to DE 10 2006 041 881.6, filed Sep. 6, 2006, the disclosures of which are expressly incorporated herein by reference.

FIELD OF THE INVENTION

The present invention is directed to an ink metering device of a printing couple and to a method of controlling the ink metering device. The ink metering device has a number of physical zones that are arranged side by side in the longitudinal direction of the printing couple cylinders. These zones can be adjusted separately using metering elements for each zones.

BACKGROUND OF THE INVENTION

A control device for controlling the printing of webs of material is known from DE 198 56 675 A1. An analysis table, with a group of keys for individually controlling the opening and closing of ink duct screws, is provided. The spacing of the keys from one another corresponds to the physical spacing of the respective ink duct screws.

A control element, which is situated beneath a sheet of paper that has been inspected by the press operator, and which is brought into a position that corresponds to a strip of the printed image that is to be corrected is disclosed in DE 42 16 440 B4. An automatic recognition system adjusts the relevant ink key for this zone and also for adjacent zones.

DE 10 2004 018 743 A1 discloses a device for visualizing ink metering element settings using a number of display devices. The number of display devices corresponds to the number of ink metering elements.

An ink metering device is known from DE 10 2004 022 700 B3. A panoramic ink zone, which is located between two single pages, is assigned on a display screen to both a display bar for one printed page and to a display bar for the other printed page. To prevent a contradictory adjustment via one and the same control element, a mean value for the two values that are desired by the press operator is determined. The mean value is taken into account by the shared control element.

DE 10 2004 054 599 A1 discloses a forme cylinder of a printing press. The forme cylinder supports a plurality of printing formes side by side in the axial direction.

SUMMARY OF THE INVENTION

The object of the present invention is to provide an ink metering device of a printing couple and a method of controlling such an ink metering device so as to allow standardization for different machine widths.

The object is attained in accordance with the present invention by the provision of an ink metering device of a printing couple including a forme cylinder and an inking unit. The ink metering device has a number of physical zones which are arranged longitudinally side by side in the direction of the forme cylinder. Each of these physical zones can be adjusted individually using metering elements. These metering elements control the quantity of ink to be applied in each physical zone. A control station is provided with a number of operator elements which are assigned to virtual zones of a printed page and which are usable for controlling the metering elements.

The benefits to be achieved in accordance with the present invention consist particularly in that a cost-effective and standardizable solution for inking units in newspaper printing presses is devised. The previous high cost of the customary small series production of each ink fountain and the corresponding metering elements specific to the widest variety of press and/or product formats can be decreased substantially, at least over broad areas or for series of related printing formats.

By adjusting the offsets, which arise as a result of the standardized metering elements, to the technical operating conditions using algorithmic calculations, and particularly by using a computer-supported software solution, operation can be carried out in the customary manner without significant cost to the printer.

BRIEF DESCRIPTION OF THE DRAWINGS

Preferred embodiments of the present invention are represented in the set of drawings and will be specified in greater detail in what follows.

The drawings show in

DESCRIPTION OF THE PREFERRED EMBODIMENTS

Figure 1:
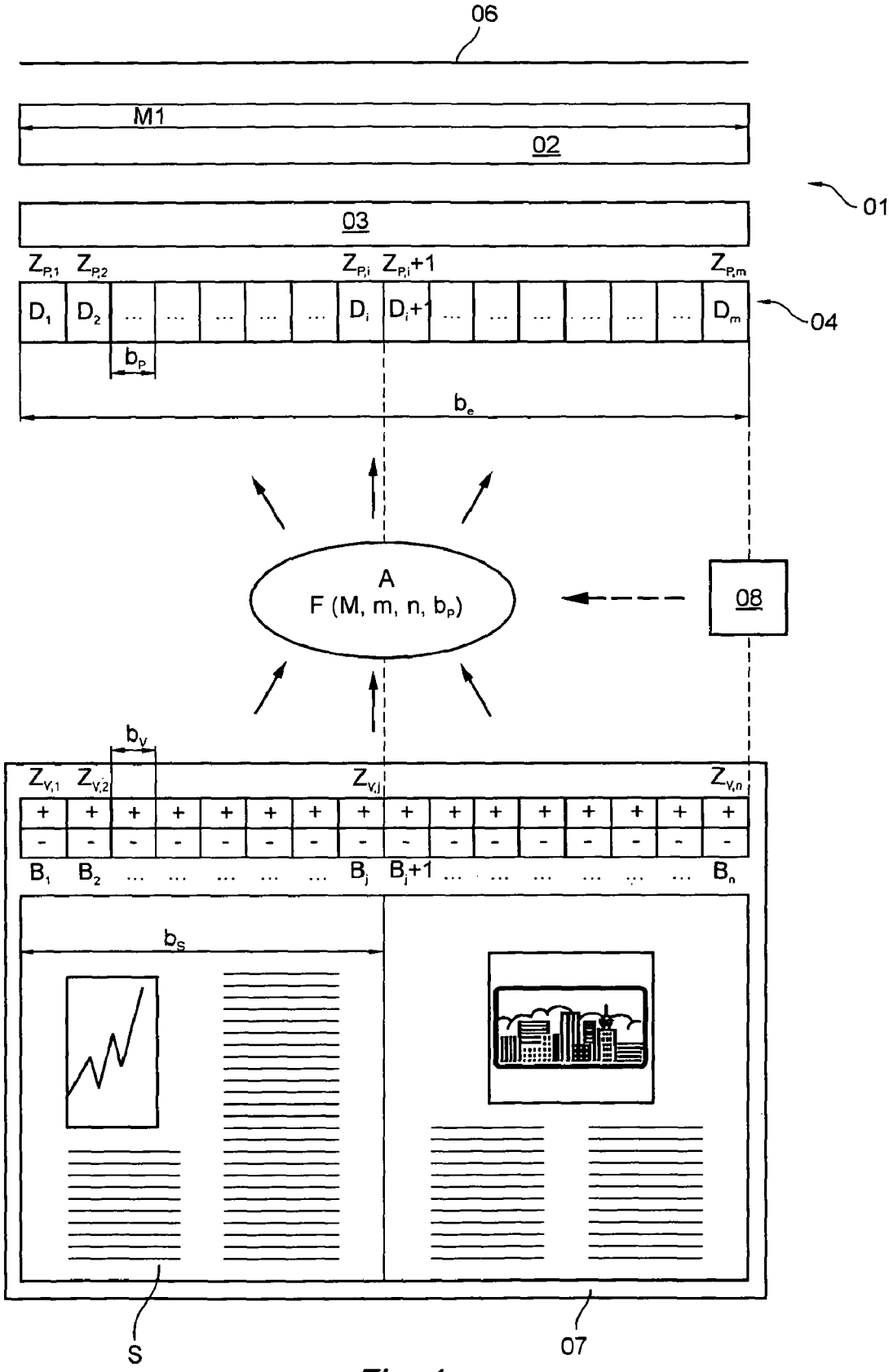
FIG. 1 a schematic representation of a printing couple and a control station for a first machine width.

A printing couple 01 of a printing press is indicated only schematically in FIG. 1. This printing couple 01 may preferably be a newspaper printing couple 01 of a newspaper printing press. Printing couple 01 has at least one printing couple cylinder 02, such as for example, a forme cylinder 02, and also has an inking unit for use in inking the forme cylinder 02. The inking unit has at least one ink roller 03 and an ink metering device 04, which ink metering device 04 works in cooperation with the ink roller 03 to achieve inking of the forme cylinder 02. A print substrate 06, especially a paper web 06, can be printed by the printing couple 01. The printing couple 01 is preferably embodied as an offset printing couple for newspaper printing, and has a transfer cylinder, which is not specifically shown, and which is situated between the forme cylinder 02 and the paper web 06. In newspaper printing, as opposed to in high-quality commercial or sheet offset printing, uncoated or only lightly coated paper, such as, for example, with a coating weight of up to 20 g/m$^2$, and especially with a coating weight of up to a maximum of 10 g/m$^2$, is printed as the print substrate. Depending upon the type of inking unit, which is being used, one or more additional rollers can be arranged between ink roller 03 and forme cylinder 02. The inking roller 03 can be provided as an ink fountain roller of a film inking unit, as an ink fountain roller of an ink pumping system or as an anilox roller of an anilox or short inking system. The forme cylinder 02 has a plurality of removable printing formes, which are not specifically shown, such as, for example two, four or six, printing formes depending upon the web width, arranged on its outer periphery. These printing formes can be arranged for example, side by side in the axial or longitudinal direction of the forme cylinder 02.

A machine width M1, and specifically an effective width of the printing couple cylinder 02, is usually adjusted to the maximum width of the print substrate or of the web of material to be printed. In newspaper printing, this machine width corresponds, for example, substantially to somewhat more than a whole number multiple of the width of one newspaper page of the desired maximum product format, or to the width of all of the printing formes that can be arranged side by side on the forme cylinder 02. Press manufacturers therefore design and supply newspaper printing presses of different machine widths for use by different publishing houses or for use by the print shops that serve them.

The print images to be applied to the print substrate 06 ordinarily require an amount of ink that varies across the width of the print image. This ink amount varies, based upon the print image, in order to achieve the desired ink density and thereby the desired inking across the width of the print image.

To ensure proper individual ink zone inking, over the entire printing width, the ink metering device 04 has a plurality of individually adjustable metering elements $D_i$ (i=1 . . . m; with m∈ℕ or with m being an element of natural numbers (1, 2, 3, 4 . . . ), side by side in an axial direction, with which plurality of individual adjustable metering elements $D_i$ the supply of ink can be controlled in each corresponding ink zone $Z_{P,i}$ (i=1 . . . m; with m∈N); index wherein P is used for identification of "physical" zones. The ink metering device 04, having a plurality of adjustable ink zones $Z_{P,i}$ can be configured in a variety of ways. In the several drawing figures, the ink metering device 04 is embodied with a plurality of metering elements $D_i$ which are configured as so-called ink blades $D_i$, or scraping elements, which ink blades D can be adjusted individually, in terms of their distance from the circumferential surface of the roller 03, via drives, which are not shown here. Based upon the gap width of this distance, the scraping by the ink blades $D_i$ leaves a thicker or a thinner film of ink on the circumferential surface of the inking roller 03, which has been placed in contact beforehand with an ink reservoir. In order to successfully ensure individual inking over the printing width or over the width of the ink fountain 04, the gap between inking roller 03 and metering element $D_i$ is adjusted by zone $Z_{P,i}$, for example, by using the drives, which are not shown here, for the individual metering elements $D_i$.

In an embodiment of the present invention, which is not specifically illustrated here, a plurality of pumps $D_i$ or a plurality of outlet openings $D_i$, each of which is provided with valves that are controllable with respect to flow and which are arranged in the flow path, can also be provided for use as the metering elements $D_i$. The ink metering device 04 and the method for controlling the ink metering device 04 will be described, by way of example, within the context of a so-called ink fountain 04 having an ink reservoir, such as an ink trough, and including the plurality of ink blades $D_i$. The principle which will be described in relation to the ink blades $D_i$ can also be applied to every other embodiment of metering elements $D_i$ that form physical zones $Z_{P,i}$.

In newspaper printing such as, for example, in inking units of newspaper printing presses, different machine widths M1; M2 are offered for different maximum product formats. Ordinarily, however, inking units, that are adapted specifically to these respective machine widths M1; M2, are used for these different machine widths M1; M2. The segmentation of the physical zones $Z_{P,i}$, which is based upon a width $b_S$ or a page width $b_S$ of one printed page S, is always chosen as a whole number wherein, for example, the number for $Z_p$ may equal 8. Thus, for example, for a newspaper printing press having a wider product format, an inking unit having a specific number of wider metering elements $D_i$ or zones $Z_{P,i}$ such as, for example, having eight such zones, has heretofore been used. For a newspaper printing press having a narrower product format, an inking unit having the same number, such as, for example, eight zones or having a different whole number of metering elements $D_i$ or zones $Z_{P,i}$, each having a smaller physical zone width $b_P$, has been used. Overall, an even number of zones $Z_{P,m}$ corresponds to the width of the printed page. The number of adjustable physical zones $Z_{P,i}$ is ordinarily reflected in the number of operator elements $B_j$ (j=1 . . . n, with n∈ℕ) with the corresponding virtual zones $Z_{V,i}$ (j=1 . . . n, with n∈ℕ) on a control station 07. In FIG. 1, for each printed page S to be placed on the control station 07, a number, such as, for example, a virtual zone number $Z_v$ equal to 8, of operator elements $B_j$, or of pairs of operator elements, each characterized by + and −, being embodied as push buttons, for example, are provided. With the use of these operator elements B, the press operator can control the metering elements $D_i$ and thereby can control the gaps to the physical zones $Z_{P,i}$. By pressing "+", for example, the flow of ink is increased, through an enlargement of gap width or through an increase in pump power, and by pressing "−", for example, the flow of ink is decreased, through a reduction of gap width or through a decrease in pump power. In this connection, as depicted in FIG. 1, the numerical and the spatial segmentation of the virtual ink zones $Z_{V,j}$ on the control station 07, as also depicted in FIG. 1, corresponds to the numerical and to the spatial segmentation of the physical ink zones $Z_{P,i}$ on the inking unit. If a presetting system 08 is provided, the required area coverages or ink densities can also be converted to the positioning of this whole number of metering elements $D_i$ or physical ink zones $Z_{P,i}$ from product definition in the production stage, through the pre-printing stage, up to the presetting system 08. In FIG. 1, a double-sided newspaper page, with each page having a page width $b_S$ and the allocated operator elements $B_i$ and/or virtual zones $Z_{V,i}$, with the virtual zone widths $b_V$, is represented schematically in the lower portion of the diagram. In this case, the virtual zone widths $b_V$ that apply to the pages placed on the platform correspond to the physical zone widths by on the inking unit. The number of virtual ink zones $Z_{V,j}$ per printed page S corresponds to the number of active physical ink zones $Z_{P,i}$. An active, effective width $b_s$ of the ink metering device 04, such as, for example, the area with metering elements $D_i$, which is required for the present machine width M1; M2, corresponds substantially to the machine width M1; M2 or to the maximum web width.

In the typical configuration of the ink metering device 04 as being specific to a particular machine width, it is a disadvantage that especially the metering elements $D_i$, have a high structural design costs. The usual disadvantages, that are known for very small series production, apply.

The method and apparatus of the ink metering device, as will be described in what follows, is based upon the concept of eliminating the requirement of specifically configured ink metering devices 04, and especially on the elimination of the metering elements $D_i$, for each specific machine width M1; M2 of a printing press 01 used in newspaper printing. Instead, in accordance with the present invention, the method and apparatus is directed to using at least the same metering elements $D_i$, and advantageously even the same ink metering devices 04, at least within certain limits, for various different machine widths M1; M2.

Figure 2:
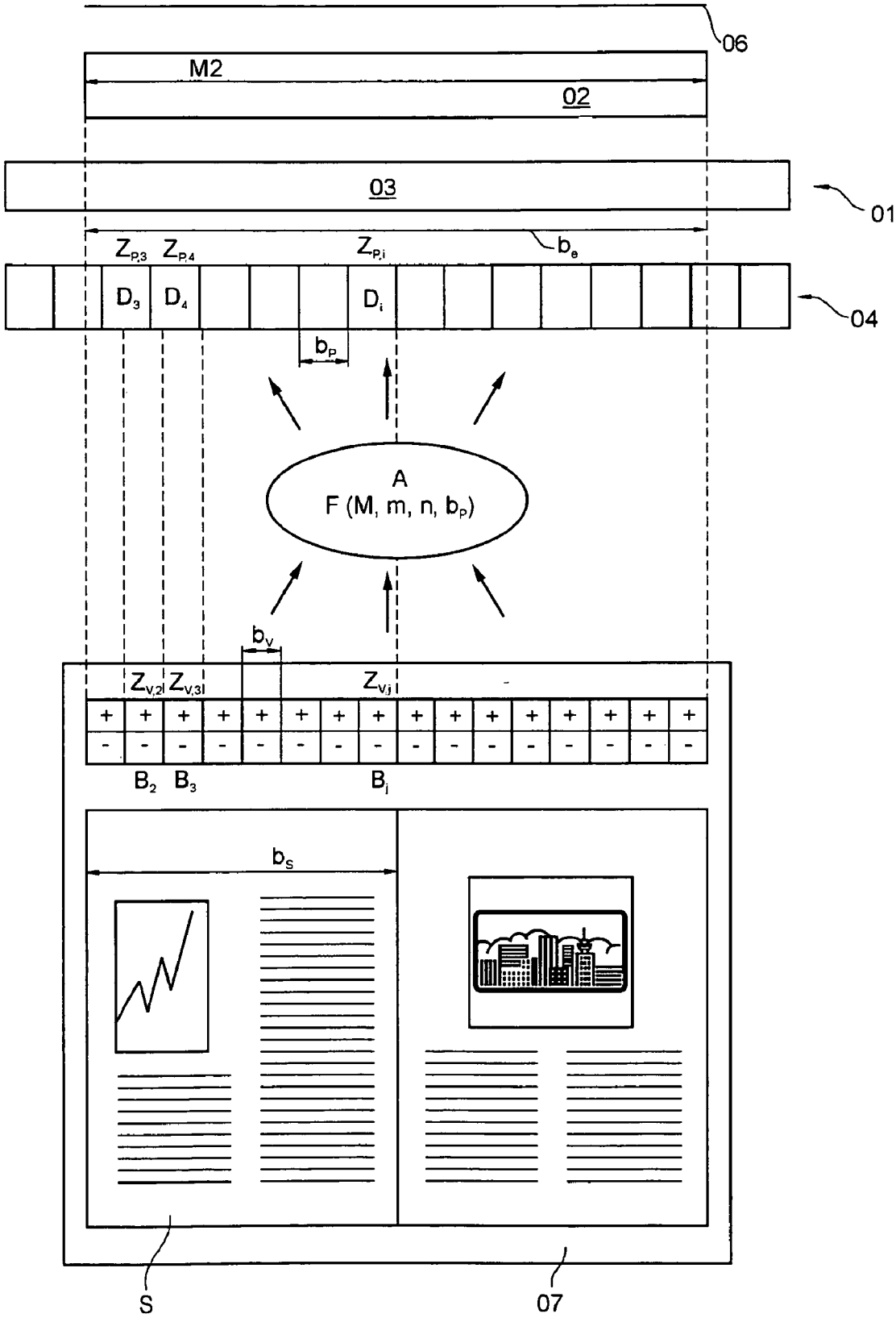
in FIG. 2 a schematic representation of a printing couple for a second machine width, with an inking unit having a lower zonal segmentation in relation to the control station; and in FIG. 3 a schematic representation of a printing couple with an inking unit having a higher zonal segmentation in relation to the control station.

In FIG. 2, there is depicted a printing couple 01 and a control station 07, which are illustrated schematically, and which are provided having a smaller product format and a narrower machine width M2 than the press which was depicted in FIG. 1. In this printing couple, a plurality of printing formes, which are narrower than those associated with the press of FIG. 1, are arranged side by side on the forme cylinder 02, for example. The support surface on the control station 07 and the width of the group of operator elements $B_i$ or the totality of the virtual ink zones $Z_{V,i}$ is also smaller or narrower in configuration, corresponding to the product to be printed. In FIG. 2, an ink fountain 04, which was structured, for example, for use with a machine width M1 from FIG. 1, is shown. The number of virtual ink zones $Z_{V,i}$ on the control station 07 that are relevant to the printed pages S is the same, for example, as was the number of such virtual zones $Z_{vj}$ for the press from FIG. 1, but each of the virtual zones $Z_{V,j}$ have a narrower zone width $b_V$ in FIG. 2. However, the ink fountain 04 has metering elements $D_i$ or has physical zones $Z_{P,i}$. The zone width $b_P$ of the physical zones $Z_{P,i}$ or of the metering elements $D_i$ is now different from the zone width $b_V$ of the virtual zones $Z_{V,j}$ of FIG. 2. In this case, it is larger. The virtual segmentation of the zones $Z_{V,j}$, on the control station 07 or at the pre-print stage, which is based upon the printed page width, or the machine width M1; M2, is different from the physical segmentation of the zones $Z_{P,i}$ on the ink metering device 04, which is based upon the printed page width, or on the machine width M1; M2. Whereas the virtual segmentation is always a whole number, a physical segmentation that is based upon the printed page width or effective width $b_s$ can also deviate from a whole number. For example, in FIG. 2 this physical segmentation can be approximately 6.3 physical ink zones per printed page S. In this case, segmentation is understood as the quotient of the number of side by side printed pages S taken into consideration and the number of allocated zones $Z_{V,j}$, $Z_{P,i}$ projected across this width $b_S$. For example, in FIG. 2: virtual segmentation 8/1 or 16/2, etc., and physical segmentation 6.3/1 or 12.6/2, etc. The segmentations of the physical and virtual zones $Z_{P,i}$, $Z_{V,j}$ can also differ in terms of spatial positioning, based upon the printed page S. In the present case, the differences consist in segmentation with respect to the number and the positioning of the zones $Z_{P,i}$, $Z_{V,j}$.

If the press operator were to perform an adjustment, using the operator element $B_3$ for its virtual zone $Z_{V,3}$, for example, and thereby actuating the drive of the metering element $D_3$, as is customary in newspaper printing, and without taking into account the different zone widths $b_P$; $b_V$ and/or the different zone positions, this would be incorrect, as may be seen in FIG. 2. To allow inking units having the same physical zone width $b_P$ to be used for different machine widths M1; M2, an algorithmic calculation A, which will be referred to here as an algorithm, is provided, which algorithm takes into account the differences between the virtual and physical zones $Z_{V,j}$, $Z_{P,i}$ in terms of number and/or position and/or width, and converts these appropriately.

As is shown in FIG. 2, the inking unit or the metering device 04 can have more than the number of metering elements $D_i$ that are absolutely necessary, or can have only as many metering elements $D_m$ as are required to fully cover the effective width $b_e$, such as, for example, the present machine width M2. In the configuration of FIG. 2, seven metering elements $D_i$ are required per margin side, because six are insufficient. In the first case, the same metering device 04 can be used for different machine widths M1; M2, and in the second case at least the same metering elements $D_i$ can be used for different widths of the metering device 04.

If, in the example depicted in FIG. 2, the print operator uses the operator element $B_3$ to adjust the virtual zone $Z_{V,3}$ assigned to a printed page strip, for example, the algorithm A is then used to perform a conversion, so that the drive of the metering element $D_4$ is actuated. Advantageously, the magnitude of the coverage or of the overlap between the position and the width of the virtual and physical zones $Z_{V,3}$ and $Z_{P,4}$ is taken into account with respect to the magnitude of the actuation signal. Because, in this case, the physical zone $Z_{P,4}$ is wider than the allocated virtual zone $Z_{V,3}$, the required actual change in the gap width is smaller than the virtually required change. If, as shown in FIG. 2, the virtual zone $Z_{V,2}$ affects a plurality of the physical zones $Z_{P,i}$, in this case affecting $Z_{P,4}$ and $Z_{P,3}$, a suitable conversion is performed such that a plurality of metering elements $D_i$, in this case $D_4$ and $D_3$, are correspondingly positioned, or their drives are correspondingly actuated, advantageously taking their coverage into account. The same conversion principle provides the basis for the, or for an algorithm for a presetting system 08, or for the prepress stage, if the preset values for the physical zones $Z_{P,i}$ are to be determined from the otherwise customary standardized, whole number coordinated zones. It is advantageous, however, if, in the presetting system 08 or in the prepress stage, the actually implemented physical zones $Z_{P,i}$ are already accounted for in the calculation of the preset values from the required area coverages or ink densities, and are stored there in the corresponding programs.

In another preferred embodiment of the principle of the present invention, as described in connection with FIG. 1 and FIG. 2, in FIG. 3 another embodiment of a metering device 04 is shown. In this embodiment, the width $b_P$ of each of the physical zones $Z_{P,i}$ is narrower than is the width $b_V$ of the corresponding virtual zones $Z_{V,j}$ on the control station 07 or in the standard settings of the presetting system. What has been described above, in reference to FIGS. 1 and 2, is similarly applicable in the embodiment of FIG. 3. The virtual and the physical or the effective segmentation of the zones $Z_{V,j}$, $Z_{P,i}$ are again different from one another. The algorithm A again ensures that when a specific virtual zone $Z_{V,j}$ is selected, a corresponding transfer to the relevant metering element $D_i$ or to the corresponding metering elements $D_i$, or to their drive or drives occurs. Here, the physical segmentation is in whole numbers, in this case nine, by way of example. However it could also differ from a whole number, based upon the printed page width or on the effective width $b_e$ of the ink metering device 04. The virtual segmentation, or the number of zones $Z_{V,j}$ or operator elements $B_j$ per printed page S, is a whole number and, in this case, is eight.

Figure 3:
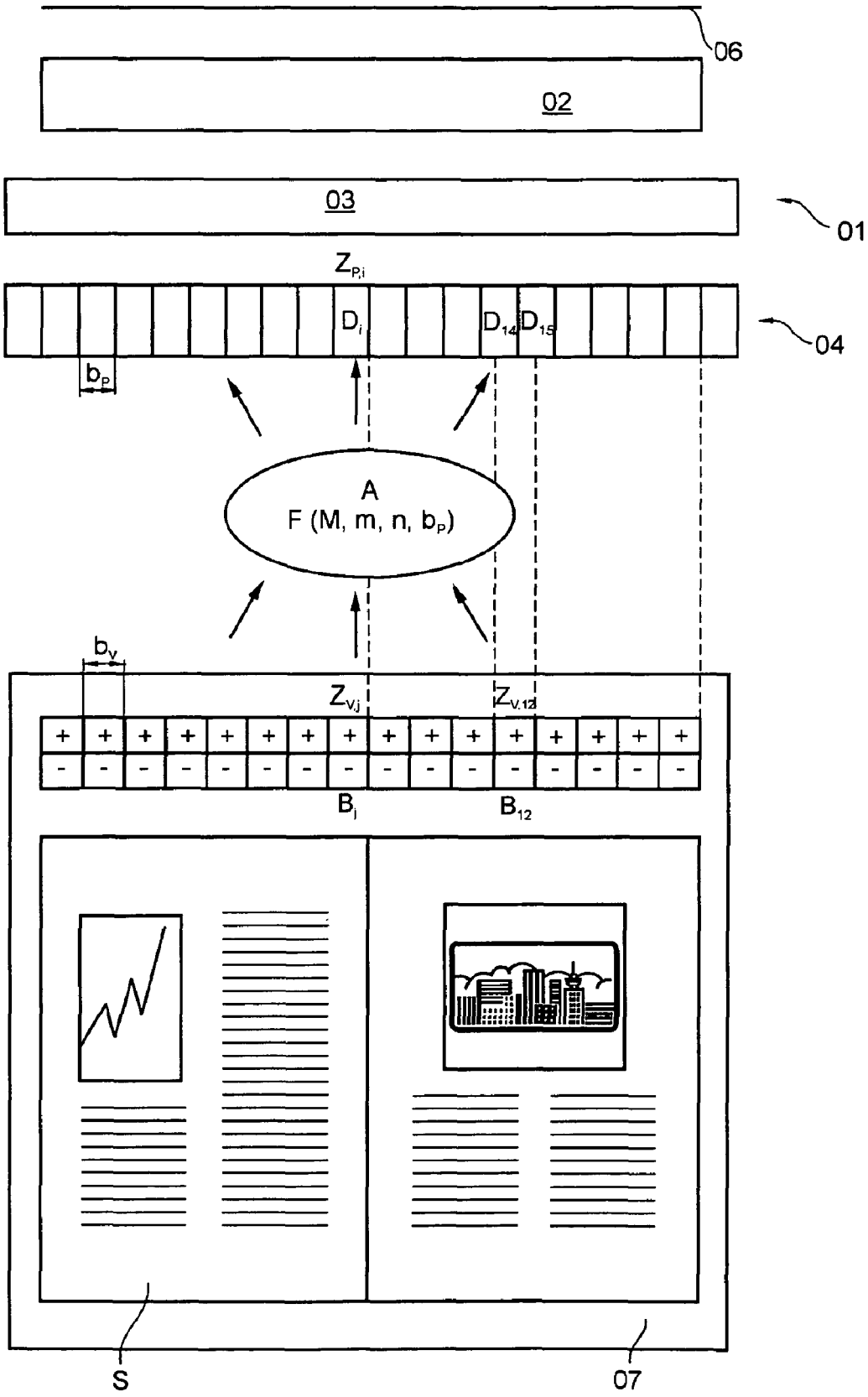

In the embodiment which is depicted in FIG. 3, if the press operator wishes to use the operator element $B_{12}$ to modify the virtual zone $Z_{v,12}$ which is allocated to a printed page strip, for example, the algorithm A will perform a conversion such that the drives for the metering element $D_{14}$ and for the metering element $D_{15}$ are both actuated. The magnitude of the respectively necessary changes to the gap can then again take into account the degree of coverage or overlap between the relative position and width $b_V$; $b_P$ of the relevant virtual and physical zones $Z_{V,j}$, $Z_{P,i}$.

In general, the ink metering device 04 has a number "m" of metering elements $D_i$ such that the total of the widths $b_P$ of the zones of the number "m" of metering elements $D_i$ is greater than, or is equal to the machine width M1; M2 or the maximum web width. The width of the ink metering device 04 is thus configured accordingly. If, as in the case of the examples or the embodiments of FIG. 2 and FIG. 3, metering elements $D_i$ are provided in margin areas of the ink metering device 04 which are outside of the effective width $b_e$, then in the algorithm A, or in the press control or presetting, it can be provided that these margin area metering elements $D_i$ are generally adjusted to a closed gap. In an advantageous variation of the present invention in relation to FIG. 2 and to FIG. 3, it is provided that a varying total width of the ink metering device 04 is permitted, but only in stages of the same metering elements $D_i$ that are used for different machine widths M1; M2. In other words, the number "m" of metering elements $D_i$ in the ink metering device 04 is such that the total of the widths $b_P$ of the zones $Z_{P,i}$ is greater than, or is equal to the machine width M1; M2. However, an (m+1)th metering element $D_{m+1}$ would lie completely outside of the effective width $b_e$ or would lie outside of the projection of the machine width M1; M2.

The control station 07 therefore continues to be embodied, as is customary, with a whole number, and advantageously with an even whole number, "n", of virtual zones $Z_{V,j}$ and/or with the corresponding number "m" of operator elements $B_j$, such as, for example, "n" pairs of push buttons $B_j$. The ink metering device 04 is configured with a different segmentation of zones $Z_{P,i}$ of a standardized width $b_P$ and optionally with a different number "m". The offsets between virtual and physical zones $Z_{V,j}$, $Z_{p,l}$, which are dependent upon format and/or number of zones and/or zone width, are converted and are taken into account using the algorithm A, especially with computer support. Corresponding computing assemblies, containing the algorithm, are provided for this purpose. The algorithm A can be a function, among other things, of the machine width M1; M2 defined by the maximum web width and/or of the number "m" of physical zones $Z_{P,i}$ or of metering elements $D_m$ and/or of the number "n" of virtual zones $Z_{V,j}$ or of operator elements $B_j$ and/or of a width $b_P$ of the physical zones $Z_{P,i}$. The algorithm A contains fixed rules for the conversion or for the consideration of the offsets or of the difference in the number and/or the position of the zones $Z_{V,j}$; $Z_{P,i}$. These fixed rules and/or the aforementioned input parameters, such as machine width, "m", "n", and the like can be defined, but stored in the computing assembly so as to be modifiable by press operators.

In the presetting process, the preset values for the metering elements $D_i$ or for the area coverages can advantageously be based directly on the physical zone number "m" and on the physical zone width $b_P$. It is also possible, however, for the preset values or for the area coverage values to be based on the zone number "n" on the control station 07, converted there using the algorithm A to accommodate the physical conditions in the manner described above, and acted upon by those of the metering elements $D_i$ or their drives.

For all the examples or embodiments depicted in FIG. 2 and in FIG. 3, or the operating types, in which the segmentation of physical and virtual zones $Z_{P,i}$, $Z_{V,j}$, based upon the printed page width, differs, a plurality of metering elements $D_i$, such as, for example, at least two metering elements, are assigned to at least one of the operator elements $B_j$ via the computing assembly or the algorithm which is implemented therein, or are relevant with respect to control. In turn, a plurality of operator elements $B_j$, and especially two such operator elements $B_j$, can be assigned to one of the plurality of metering elements $D_i$, based upon overlap. The plurality of metering elements $D_i$ that are relevant to an operator element $B_j$ are preferably positioned taking into account the degree of their coverage in relation to the operator element $B_j$.

For the aforementioned preferred embodiments of the present invention, which are illustrated in FIG. 2 and in FIG. 3, it is also characteristic not only for a metering element $D_i$, which is situated between two printed pages S, to be assigned two operator elements $B_j$ of two adjacent printed pages S, but also for an adjustment to the overlap to be made for a plurality of operator elements $B_j$ and metering elements $D_i$ which are assigned to a printed page S, using the algorithm A. Therefore, based upon the printed page S, a plurality of zones are offset with respect to their position, or are different in terms of their number.

While preferred embodiments of an ink metering device of a printing couple and a method of controlling the ink metering device, in accordance with the present invention, have been set forth fully and completely hereinabove, it will be apparent to one of skill in the art that various changes in, for example, the drives for the cylinders, the specific ink being metered and the like could be made without departing from the true spirit and scope of the present invention which is accordingly to be limited only by the appended claims.

What is claimed is:

1. An ink metering device (04) of a printing couple (01) having a printing couple cylinder (02) embodied as a forme cylinder (02) and an inking unit, said ink metering device (04) having a first number (m) of physical ink zones ($Z_{P,i}$) arranged side by side in the longitudinal direction of the printing couple and each having a first ink zone width, which first number of physical ink zones can each be adjusted individually using a first number of physical ink metering elements ($D_i$), for the individual, section by section adjustment of a quantity of ink to be applied, to each of a number of print ink zones of a printed page of a print substrate, and further having a control station (07) which control station has a first number (n) of fixed width operator elements $B_i$ assigned to a first number of virtual ink zones ($Z_{V,j}$) of the printed page, said operator elements being usable for controlling said metering elements of said physical ink zones ($D_i$), wherein a segmentation of the physical ink zones ($Z_{P,i}$) of the ink metering device (04), based upon a width ($b_S$) of the printed page, and with respect to at least one of a number and position of the physical ink zones ($Z_{P,i}$) of the ink metering device (04) across the width ($b_S$) of a printed page (S) is different from a segmentation of the virtual ink zones ($Z_{V,i}$) on the control station (07), based upon the width of the printed page, with respect to at least one of a number and position of the virtual ink zones ($Z_{V,j}$) on the control station (07) across the width ($b_S$) of a printed page (S), and wherein at least two of said first number of physical ink metering elements ($D_i$) are assigned to at least one of the operator elements assigned to said virtual ink zone ($B_j$), using a computing means, with respect to relevance in the positioning process and following the selection of said operator element assigned to said ink zone ($B_i$), said first number of said operator elements being a fixed number with a fixed width that is invariant with respect to a variable width of the printed page printed by the printing couple, said inking unit having an inking unit width greater than a maximum width of the print substrate capable of being printed by the printing couple.

2. The ink metering device in accordance with claim 1, characterized in that the first number of physical zones ($Z_{P,i}$) of the physical ink metering elements ink metering device (04) and the virtual ink zones ($Z_{V,j}$) of the control station (07) are embodied having widths ($b_P$, $b_V$) that differ from one another.

3. The ink metering device in accordance with claim 1, characterized in that said first number (np) of said physical ink zones ($Z_{P,i}$) based upon the width ($b_S$) of one printed page (S) may differ from a whole number as a function of said width of said one printed page.

4. The ink metering device in accordance with claim 1, characterized in that said computing means is equipped with an algorithm (A), which is configured to account for said differences in segmentation between said virtual ink zones and said physical ink zones ($Z_{V,j}$; $Z_{P,i}$) in controlling said physical ink metering elements ($D_i$), based upon established rules with respect to said relevance in said positioning process.

5. The ink metering device in accordance with claim 1, characterized in that said computing means is located in a signal path between the operator elements ($B_j$) on the control station and drives for the physical ink metering elements ($D_i$).

6. The ink metering device in accordance with claim 1, characterized in that the ink metering device (04) cooperates with a roller (03) of said inking unit.

7. The ink metering device in accordance with claim 1, characterized in that the forme cylinder (02) to be inked up by the inking unit supports a plurality of printing formes on its outer periphery, side by side in an axial direction of the forme cylinder.

8. The ink metering device in accordance with claim 1, characterized in that the control station (07) has a whole number (n) said virtual ink control zones ($Z_{V,j}$).

9. A method for controlling an ink metering device of a printing couple having a printing couple cylinder and including:

providing a first number of physical ink zones in said ink metering device;

providing a first number of physical ink metering elements, said first number of physical ink zones and said first number of physical ink metering elements being determined by one printed page width of a print substrate printable by said printing couple;

providing a control station for said printing couple;

providing a second number of virtual ink zones on said control station;

providing a second number of fixed width operator elements on said control station;

determining said second number of virtual ink zones based on said one printed page width;

providing said first number of physical ink zones and said second number of virtual ink zones different from each other in at least one of numbers and positioning based on said one printed page width;

providing an algorithm calculation taking into account said difference in said at least one of numbers and positioning of said first number of physical ink zones and said second number of virtual ink zones and based upon mathematical rules;

using said algorithm calculation for controlling said physical ink metering elements and activating a plurality of said physical ink metering elements using one of said fixed width operator elements;

providing said second number of fixed width operator elements on said control station having said second number and position invariant with respect to a width of said one printed page; and providing said ink metering device having a width greater than a maximum width of said print substrate to be printed.

10. The method of claim 9 further including activating said plurality of physical ink metering elements in accordance with coverage of selected ones of said physical ink zones inked by said ink metering device and said virtual ink zone of an activated one of said operator elements.

* * * * *